US009605868B2

(12) United States Patent
Carlyon

(10) Patent No.: US 9,605,868 B2
(45) Date of Patent: Mar. 28, 2017

(54) FAN ARRAY BACKFLOW PREVENTER

(71) Applicant: MITEK HOLDINGS, INC., Wilmington, DE (US)

(72) Inventor: Zeke Carlyon, Vassar, MI (US)

(73) Assignee: MITEK HOLDINGS, INC., Wilmington, DE (US)

( * ) Notice: Subject to any disclaimer, the term of this patent is extended or adjusted under 35 U.S.C. 154(b) by 907 days.

(21) Appl. No.: 13/829,361

(22) Filed: Mar. 14, 2013

(65) Prior Publication Data

US 2014/0273800 A1 Sep. 18, 2014

(51) Int. Cl.

| | |
|---|---|
| ***F24F 7/06*** | (2006.01) |
| ***F24F 13/14*** | (2006.01) |
| ***F24F 7/013*** | (2006.01) |
| ***F24F 13/20*** | (2006.01) |
| ***F04D 25/04*** | (2006.01) |

(52) U.S. Cl.

CPC ..... *F24F 13/1426* (2013.01); *F24F 7/013* (2013.01); *F24F 7/065* (2013.01); *F24F 13/14* (2013.01); *F24F 2013/205* (2013.01)

(58) Field of Classification Search

None

See application file for complete search history.

(56) References Cited

U.S. PATENT DOCUMENTS

| | | | | |
|---|---|---|---|---|
| 1,189,572 A | | 7/1916 | Ilg | |
| 1,251,593 A | | 1/1918 | Truitt | |
| 1,935,216 A | | 11/1933 | Sievert | |
| 2,104,279 A | | 1/1938 | Sperry | |
| 2,687,687 A | | 8/1954 | Prudhon | |
| 2,775,928 A | | 1/1957 | Morrison | |
| 2,819,845 A | * | 1/1958 | Ziph | F23L 11/02 236/45 |

(Continued)

FOREIGN PATENT DOCUMENTS

| | | |
|---|---|---|
| CA | 2551541 | 1/2007 |
| CA | 2728811 | 7/2011 |

(Continued)

OTHER PUBLICATIONS

Backdraft Damper for Air handlers with Fanwall Technology, Model FBD Brochure, Temtrol LLC, Dec. 2010, 2 pages.

(Continued)

*Primary Examiner* — Gregory Huson
*Assistant Examiner* — Eric Gorman
(74) *Attorney, Agent, or Firm* — Senniger Powers LLP

(57) ABSTRACT

A backflow preventer for use in a multiple fan array system that draws air from an inlet area and expels it into a discharge area includes a main body defining an open front end and an open rear end and is adapted for attachment to a fan of the fan array system adjacent an inlet of the fan. Doors are attached to the main body and configured for movement between an open position in which air is permitted to enter through the open front end and a closed position in which the doors block the open front end and air is prevented from entering through the open front end. The doors are movable between the open position and the closed position by a pressure differential between the inlet area and the discharge area. The doors in the open position form a tapered intake passageway that funnels air into the fan.

21 Claims, 10 Drawing Sheets

(56) References Cited

U.S. PATENT DOCUMENTS

| | | | | |
|---|---|---|---|---|
| 2,924,166 | A * | 2/1960 | Gerlitz | F24F 7/025 415/148 |
| 3,204,548 | A | 9/1965 | McCabe | |
| 3,334,569 | A | 8/1967 | Lambie | |
| 4,094,336 | A | 6/1978 | Urschel et al. | |
| 4,823,679 | A * | 4/1989 | Robbins | F24F 7/007 454/253 |
| 5,050,667 | A * | 9/1991 | Berner | F24F 7/065 165/137 |
| 5,136,922 | A * | 8/1992 | Piesik | F41F 3/0413 89/1.812 |
| 5,167,578 | A * | 12/1992 | Legault | F24F 7/00 454/350 |
| 5,845,999 | A | 12/1998 | Kearney | |
| 6,011,689 | A | 1/2000 | Wrycraft | |
| 6,042,348 | A | 3/2000 | Aakalu et al. | |
| 6,115,250 | A | 9/2000 | Schmitt | |
| 6,837,785 | B2 | 1/2005 | Soderlund | |
| 6,953,320 | B1 | 10/2005 | Davis et al. | |
| 7,416,481 | B2 | 8/2008 | Baker et al. | |
| 7,478,666 | B2 * | 1/2009 | Yamamoto | B60H 1/00028 165/204 |
| 2004/0081553 | A1 * | 4/2004 | Milana | F04D 25/14 415/121.2 |
| 2006/0081367 | A1 * | 4/2006 | Chiu | F04D 29/161 165/296 |
| 2007/0010191 | A1 * | 1/2007 | Vanden Bosch | F24F 7/00 454/359 |
| 2007/0178827 | A1 * | 8/2007 | Erni | F24F 7/025 454/353 |
| 2008/0145246 | A1 * | 6/2008 | Lee | F04D 29/526 417/423.14 |
| 2008/0233861 | A1 * | 9/2008 | Jenkins | F04D 25/14 454/241 |
| 2008/0242215 | A1 * | 10/2008 | Pagenstert | A01K 1/0064 454/284 |
| 2009/0081942 | A1 * | 3/2009 | Vanden Bosch | F24F 13/14 454/359 |
| 2009/0262499 | A1 | 10/2009 | Chou | |
| 2011/0028080 | A1 | 2/2011 | Hopkins et al. | |
| 2011/0028081 | A1 | 2/2011 | Hopkins et al. | |
| 2011/0183600 | A1 * | 7/2011 | Chua | F24F 7/06 454/358 |
| 2011/0303395 | A1 * | 12/2011 | Mori | F01P 3/18 165/104.34 |
| 2012/0148387 | A1 * | 6/2012 | Labrecque | F04D 25/14 415/148 |
| 2012/0149293 | A1 * | 6/2012 | Labrecque | F24F 13/14 454/353 |
| 2012/0149294 | A1 * | 6/2012 | Labrecque | A01K 1/0052 454/353 |
| 2012/0214394 | A1 * | 8/2012 | Kanemaru | B60H 1/00471 454/139 |
| 2013/0072105 | A1 * | 3/2013 | Yang | F04D 25/08 454/350 |
| 2014/0141706 | A1 * | 5/2014 | Richter | B60H 1/00685 454/141 |
| 2014/0242902 | A1 * | 8/2014 | Ali | F24F 13/14 454/359 |
| 2015/0140923 | A1 * | 5/2015 | Penlesky | F24F 7/007 454/322 |
| 2015/0252813 | A1 * | 9/2015 | Shih | F04D 25/14 415/146 |
| 2015/0306935 | A1 * | 10/2015 | Shichiken | B60H 1/0005 165/47 |

FOREIGN PATENT DOCUMENTS

| | | | |
|---|---|---|---|
| DE | 518 440 | C | 2/1931 |
| DE | 201 15 688 | U1 | 12/2001 |
| DE | 20 2006 004 839 | U1 | 6/2006 |
| GB | 674 770 | A | 7/1952 |

OTHER PUBLICATIONS

Extended European Search Report for Application No. EP 14158439, Sep. 5, 2014, 7 pages.

Canadian Examiner's report for Application No. CA 2,845,943, Feb. 17, 2016, 4 pages.

Mexican Examiner's Report for Application No. MX/a/2014/003052 with English translation, Jun. 16, 2016, 8 pages.

Mexican Examiner's Report for Application No. MX/a/2014/003052 with English translation, Dec. 7, 2016, 4 pages.

* cited by examiner

FAN ARRAY BACKFLOW PREVENTER

FIELD OF THE INVENTION

The present invention generally relates to fan array systems, and more specifically, to a backflow preventer for a fan array system.

BACKGROUND OF THE INVENTION

Air handling systems used to condition buildings or rooms typically include a structure having components designed to condition air as part of the primary ventilation system of the buildings. These air handling systems often include multiple fans and require backflow preventers or dampers to prevent air from flowing in the direction opposite normal air flow if one of the fans becomes disabled. Conventionally, there are three types of backflow dampers: manually operated backflow dampers, gravity actuated backflow dampers, and backflow dampers actuated by an electric motor. All of the typical backflow preventers tend to decrease the efficiency of the fans. The backflow preventers that are operated manually or by electric motor require additional parts and structure, which makes these backflow preventers more complicated and can disrupt the air flowing through the fans. The gravity actuated backflow preventers require that the air flow of the fan be strong enough to overcome the gravitational force of the dampers to open or close the backflow preventer. This required force reduces the efficiency of the fans in the air handling system.

SUMMARY OF THE INVENTION

In one aspect, a backflow preventer for use in an air handling system including at least one fan having an inlet and an outlet for drawing air from an inlet area and expelling air into a discharge area includes a main body. The main body has a top wall, a bottom wall, and opposed side walls extending between the top and bottom walls. The main body defines an open front end and an open rear end and is adapted for attachment to the fan of the air handling system adjacent the inlet of the fan such that air flowing into the fan inlet must first pass through the main body. Doors are attached to the main body and configured for movement between an open position in which air is permitted to enter through the open front end to flow toward the open back end and a closed position in which the doors block the open front end and air is prevented from entering through the open front end to flow toward the open back end. The doors are movable between the open position and the closed position by a pressure differential between the inlet area and the discharge area.

In another aspect, a multiple fan array system for use in conditioning air in a structure by drawing air from an inlet area and expelling it into a discharge area includes at least two fans. Each fan has an inlet and an outlet and is operable to draw air in through the inlet and expel air out through the outlet. A backflow preventer is operatively associated with each of the at least two fans. Each backflow preventer includes a main body defining an open front end and an open rear end and a pair of doors attached to the main body. The doors are configured for movement between an open position in which air is permitted to enter through the open front end to be drawn into the fan inlet and a closed position in which air is prevented from entering through the open front end to be drawn into the fan inlet.

Other objects and features will be in part apparent and in part pointed out hereinafter.

BRIEF DESCRIPTION OF THE DRAWINGS

Corresponding reference characters indicate corresponding parts throughout the drawings.

DESCRIPTION OF THE PREFERRED EMBODIMENTS

Figure 1:
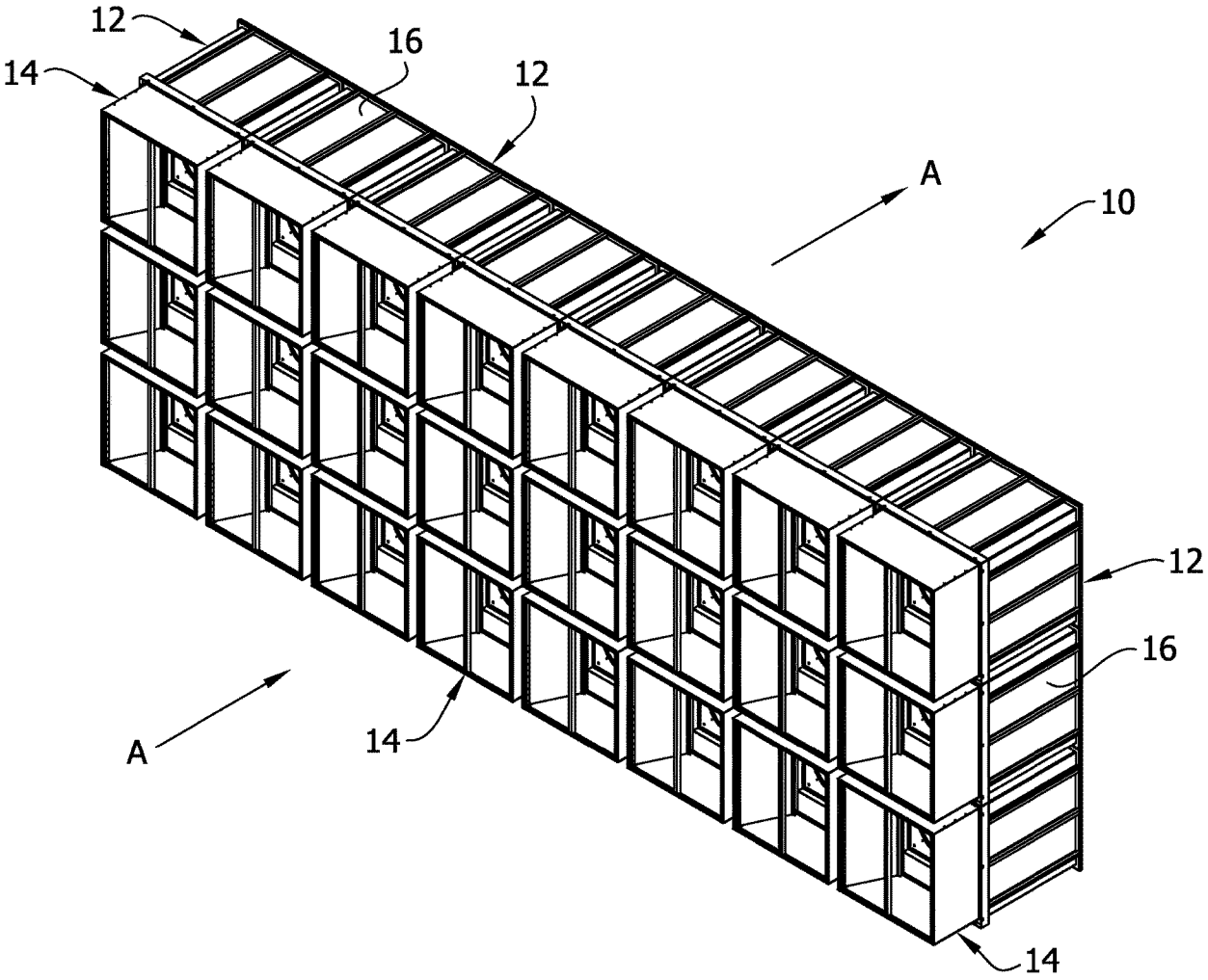
FIG. 1 is a perspective of a multiple fan array system including backflow preventers according to the present invention.
Figure 2:
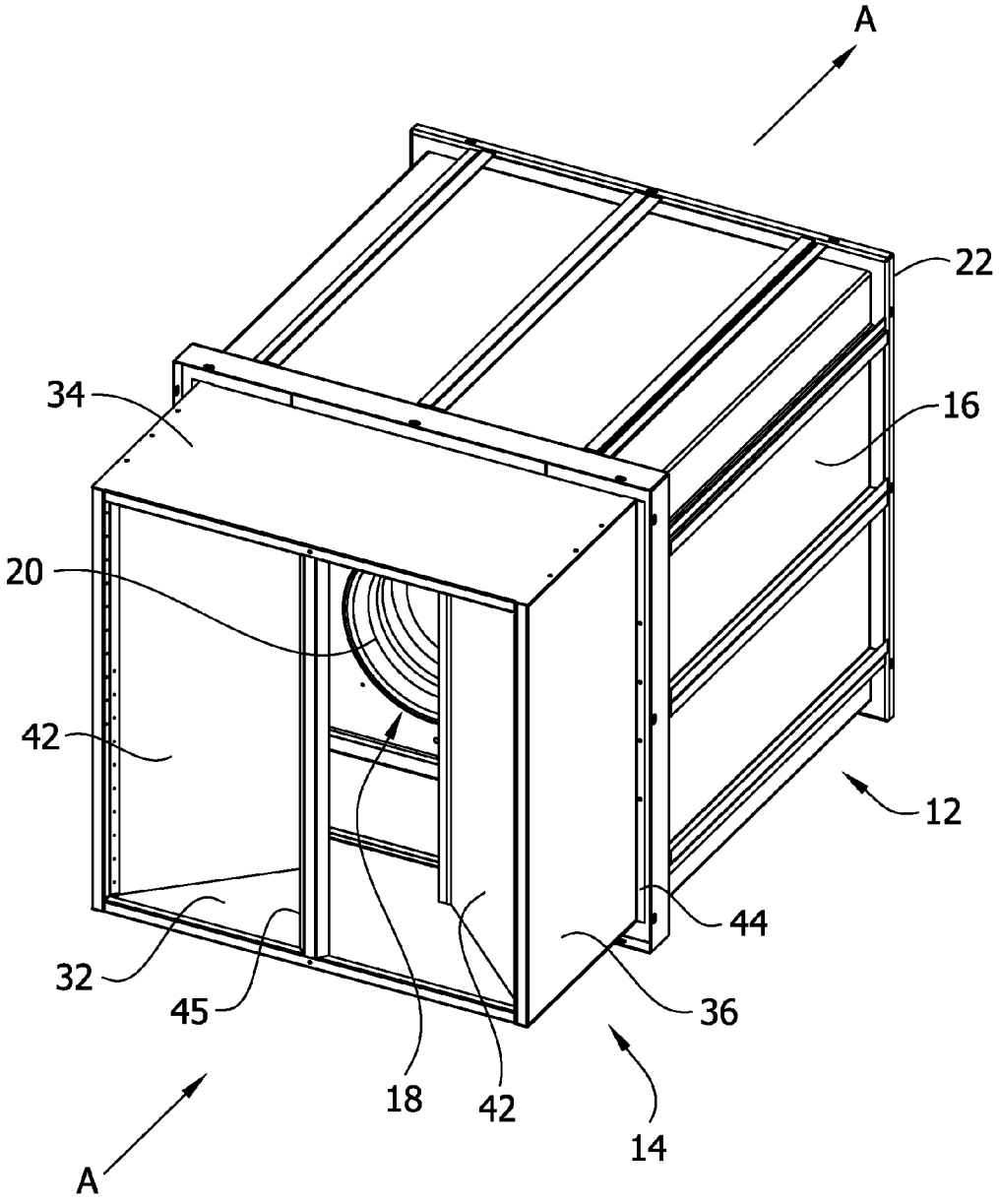
FIG. 2 is a perspective of a single fan having a backflow preventer according to the present invention mounted thereto.

Referring to FIG. 1, a fan array system is generally indicated at 10. The fan array system 10 includes a plurality of fan units 12 and a backflow preventer 14 operatively associated with each fan unit. Air flows through the fan array system 10 from an upstream side to a downstream side, as indicated by the arrows A. The backflow preventers 14 are positioned on the upstream side of the fan array system 10. FIG. 2 illustrates a single fan unit 12 with a backflow preventer 14 attached thereto. The fan array system 10 including the backflow preventers 14 can be used in a conventional air-handling system, as is known in the art. The number and arrangement of fans and backflow preventers may be other than described without departing from the scope of the present invention.

As seen in FIGS. 1 and 2, each fan unit 12 includes a housing 16 and a fan 18. The fan 18 includes a motor (not shown), an inlet 20 and an outlet 22 opposite the inlet. The fan 18 draws air in through the inlet 20 and expels it through the outlet 22, as is known in the art. In one embodiment, the fan 18 can be a direct plenum fan, such as those sold by Zeihl-Abegg of Greensboro, N.C. and Greenheck of Schofield, Wis. Other fans can be used without departing from the scope of the present invention.

Figure 8:
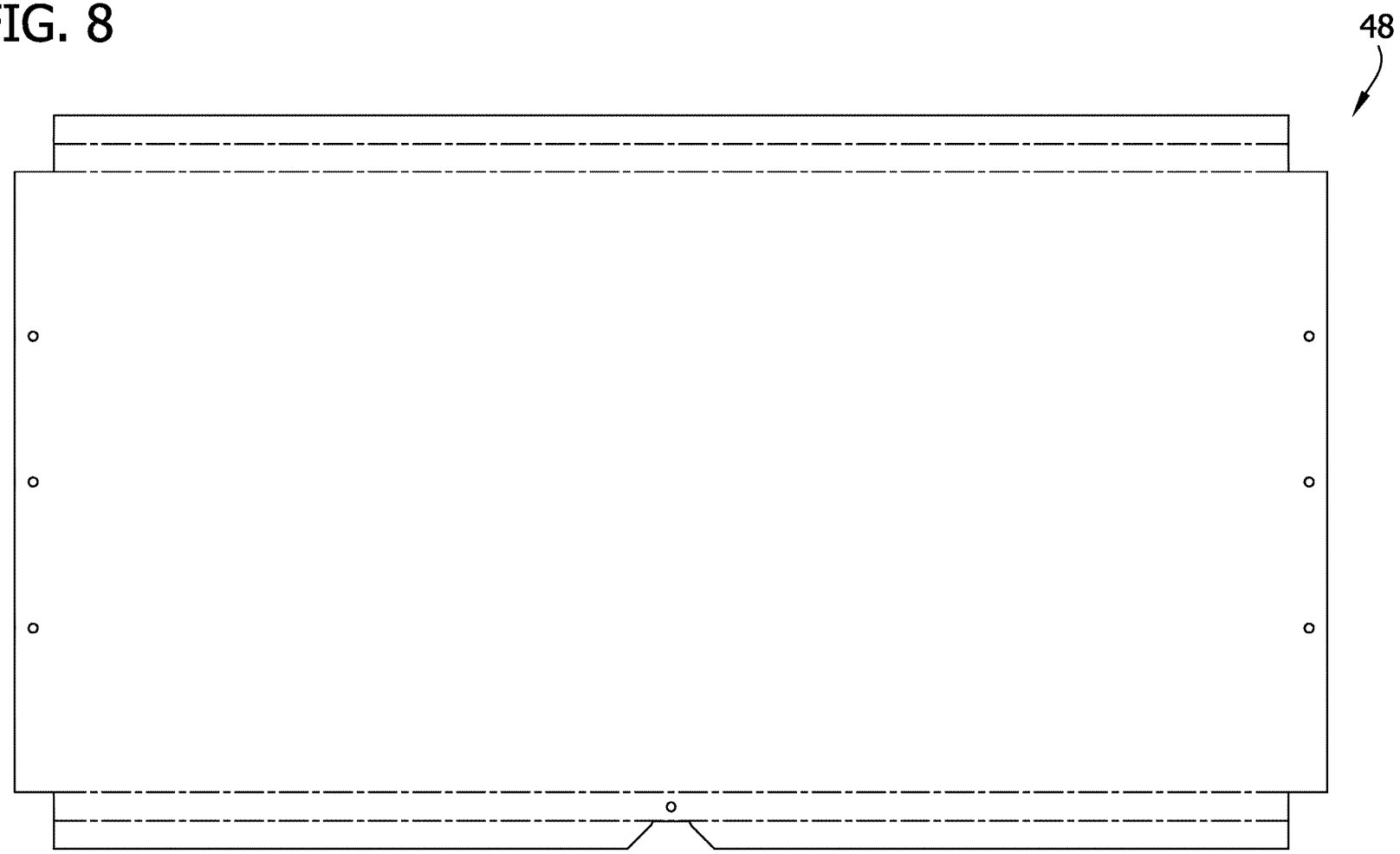
FIG. 8 illustrates a blank that can be used to form the top wall and the bottom wall of the backflow preventer.
Figure 9:
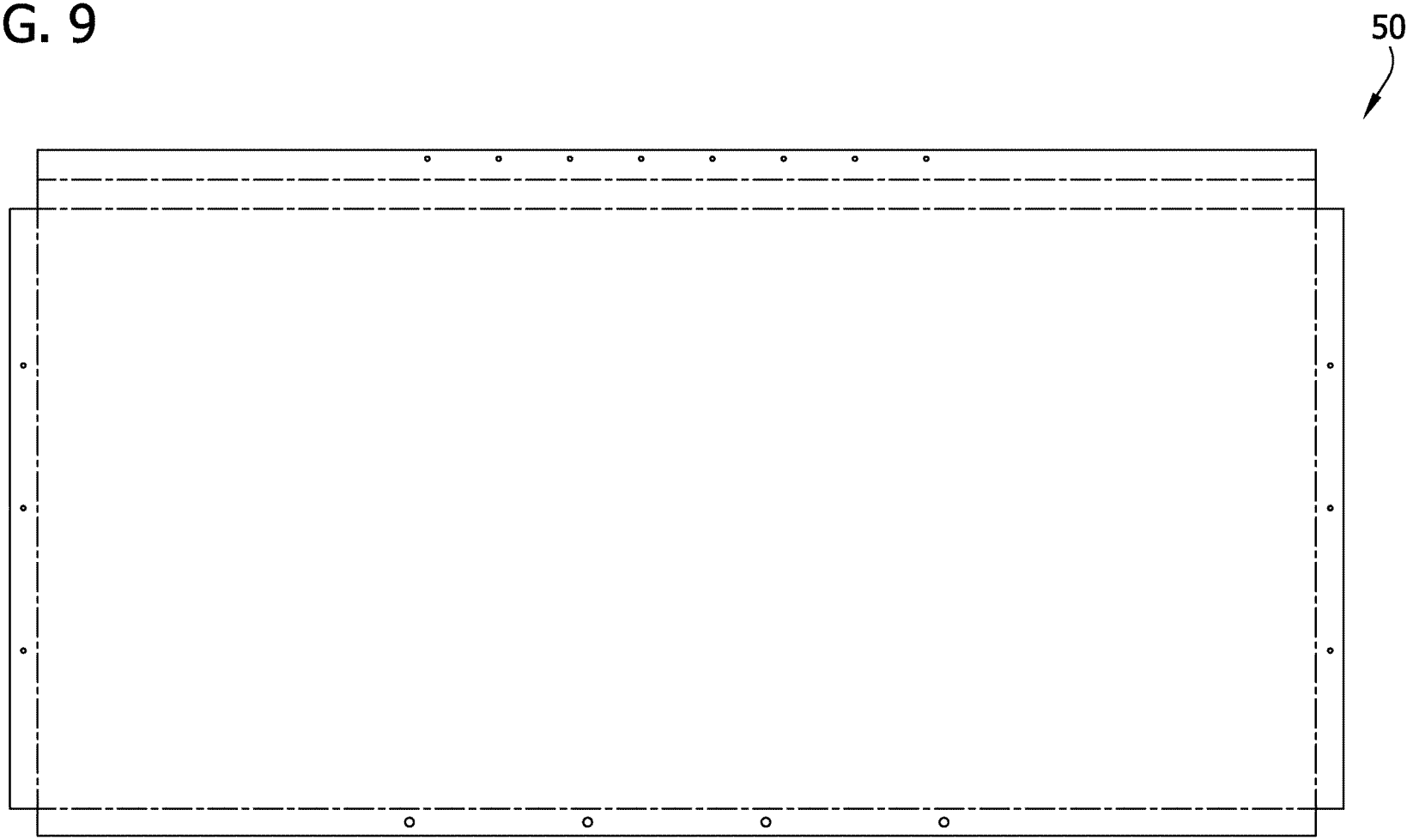
FIG. 9 illustrates a blank that can be used to form the side walls of the backflow preventer.

As illustrated in FIGS. 3-7, the backflow preventer 14 includes a main body 30 having a bottom wall 32, a top wall 34, and opposed side walls 36 extending between the bottom and top walls. The backflow preventer 14 includes an open rear end 38 and an open front end 40 that can be selectively closed by doors 42, as explained below. The backflow preventer 14 is configured for attachment to the fan unit 12. In the illustrated embodiment, each of the side walls 36 includes a flange 44 adjacent the open rear end 38 for mounting the backflow preventer 14 on the fan housing 16. The main body 30 includes a central stop 45 positioned adjacent the open front end 40 and extending from the bottom wall 32 to the top wall 34 at a position between the opposed side walls 36. The central stop 45 includes a center portion 46 and two side portions 48 extending at an angle from the center portion. In one embodiment, the side portions 48 can extend at about a 45 degree angle from the center portion 46. The bottom wall 32 and the top wall 34 can have identical construction for ease of manufacture. Similarly, the opposed side walls 36 can have identical construction. The walls can be formed from any suitable material, such as galvanized steel. In one embodiment, the walls are made from 18-gauge galvanized steel sheets folded into the desired shape from a blank. The blank 48 illustrated in FIG. 8 is an example of a blank that can be used to form both the bottom wall 32 and the top wall 34. The blank 50 illustrated in FIG. 9 is an example of a blank that can be used to form both side walls 36. The walls can be connected to each other in any conventional manner, such as by screws or other fasteners. Alternatively, the main body 30 can be formed as one piece. It is understood that other configurations and materials are within the scope of the present invention. For example, the backflow preventer 14 can include other structure for mounting the main body 30 to the fan unit 12, and the main body can be made from other suitable materials such as mill finished aluminum or stainless steel.

Figure 3:
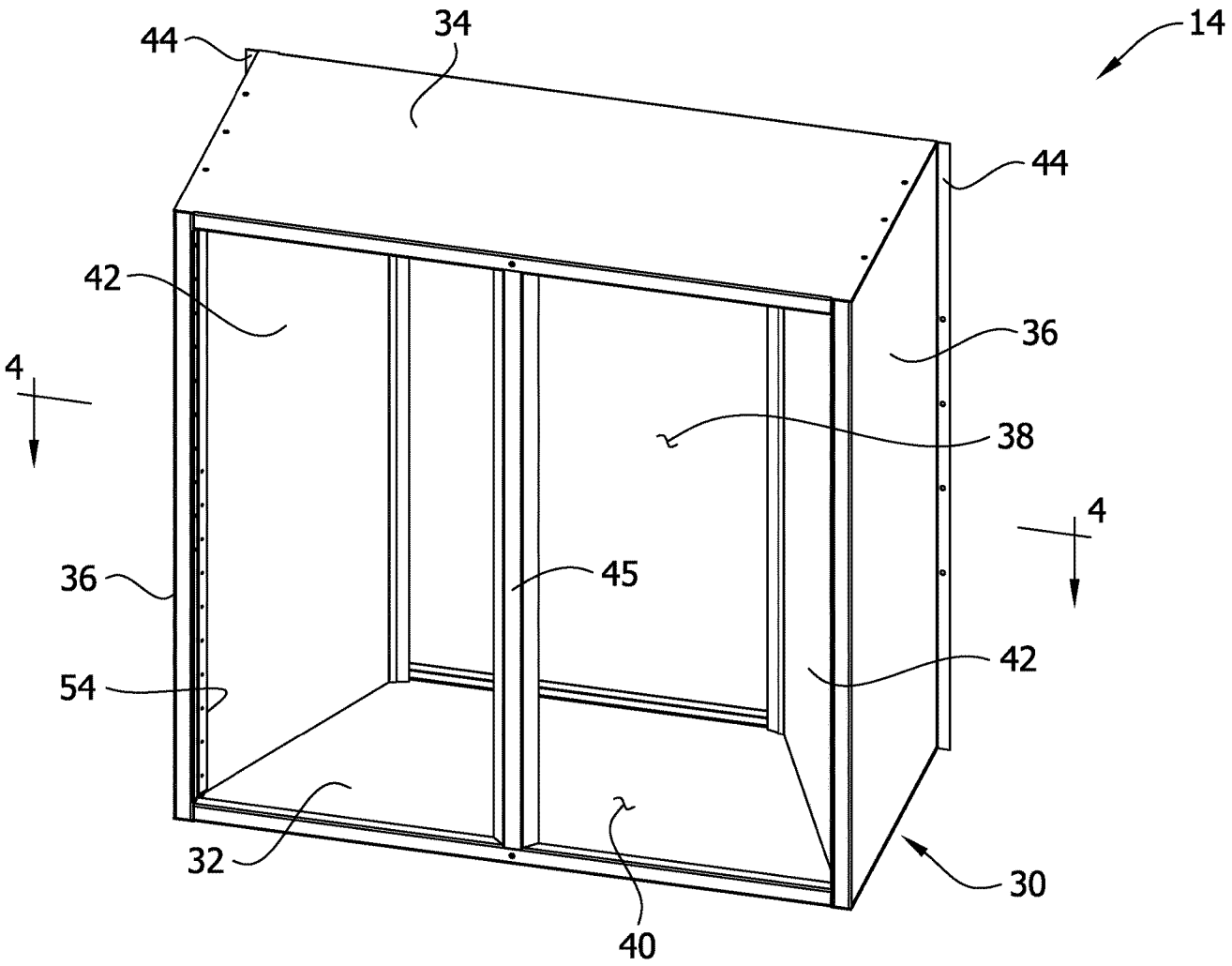
FIG. 3 is a perspective of a backflow preventer according to the present invention with the doors in the open position.
Figure 4:
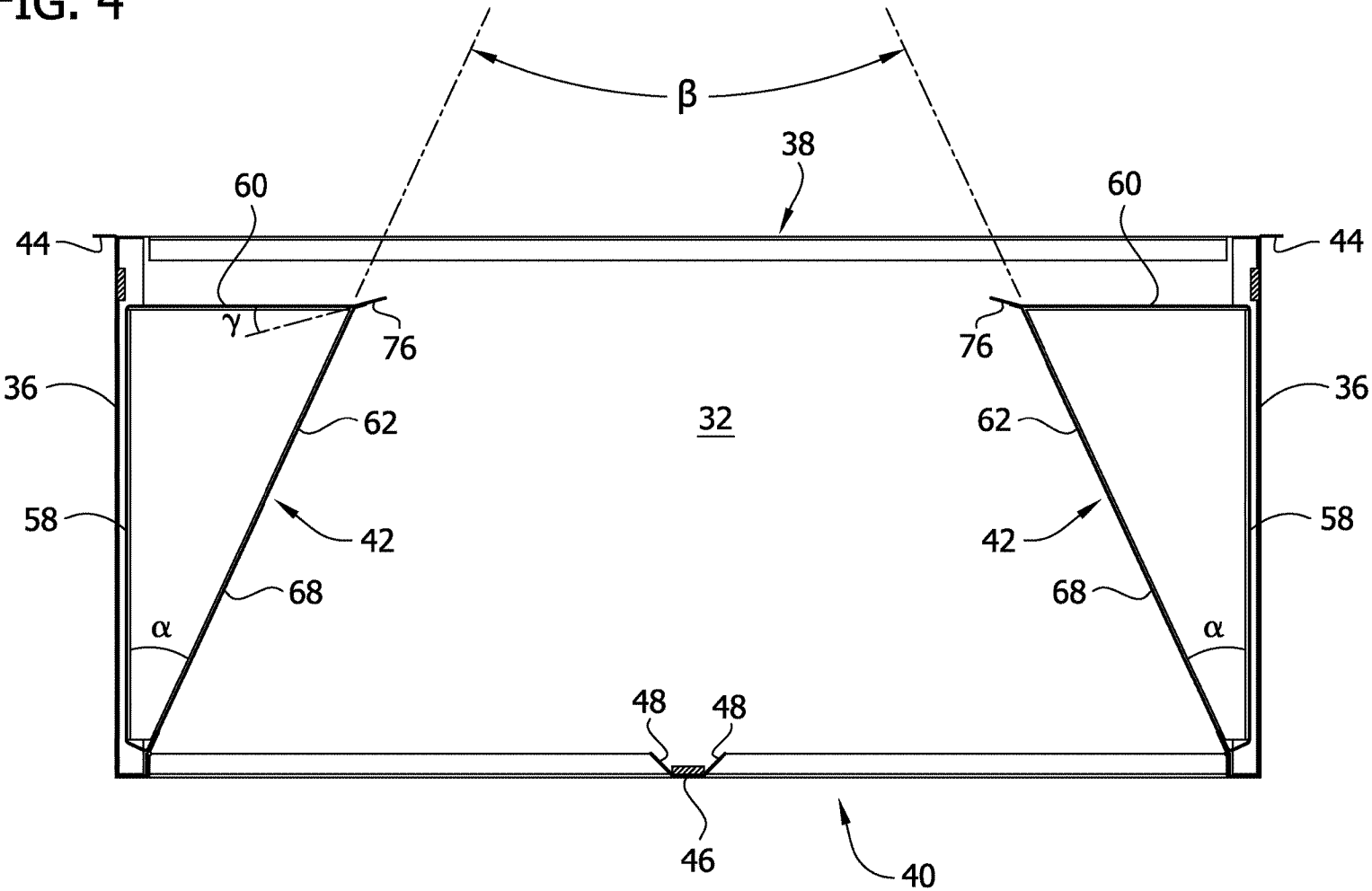
FIG. 4 is a cross section of FIG. 3 taken along line 4-4.
Figure 5:
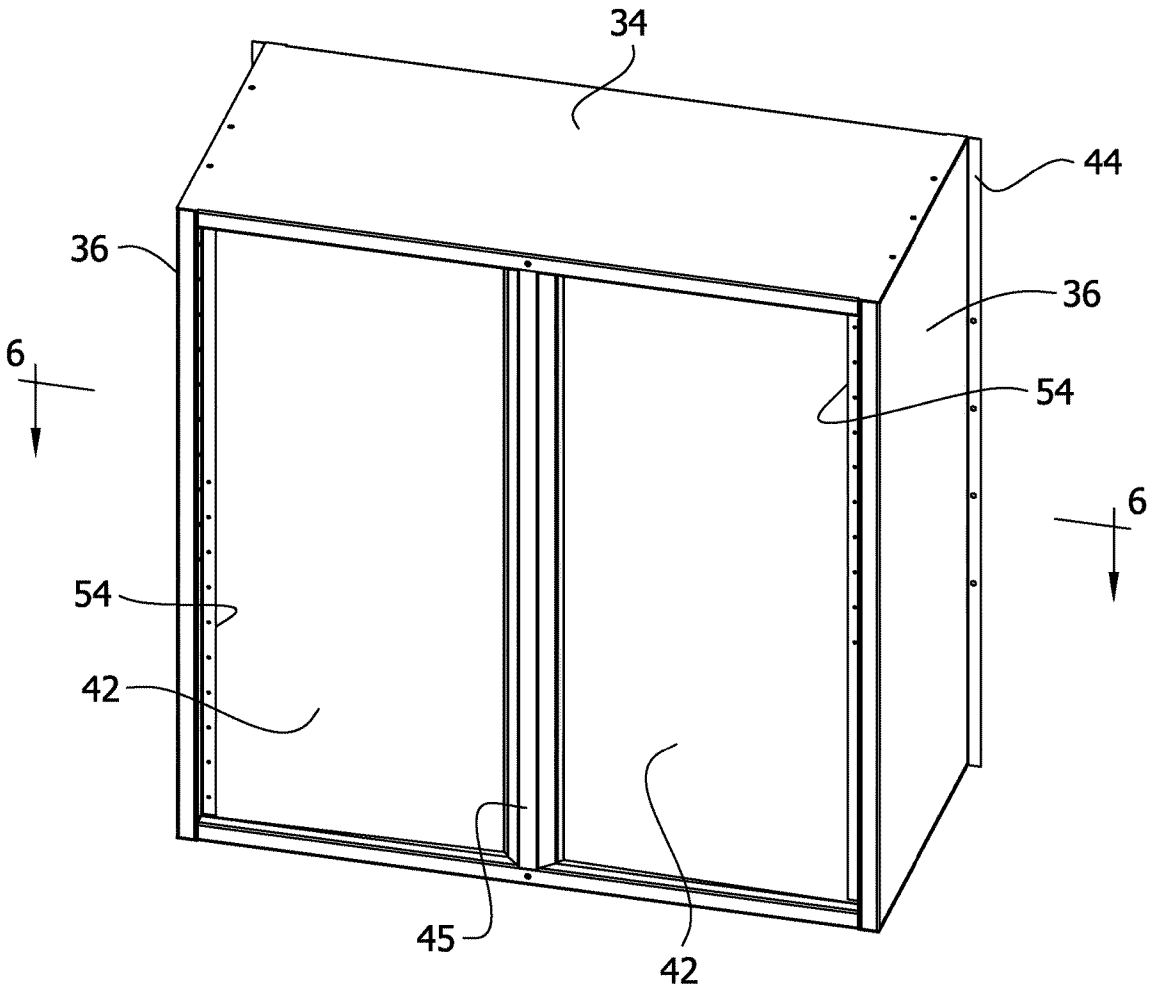
FIG. 5 is perspective of the backflow preventer of FIG. 3 with the doors in the closed position.
Figure 6:
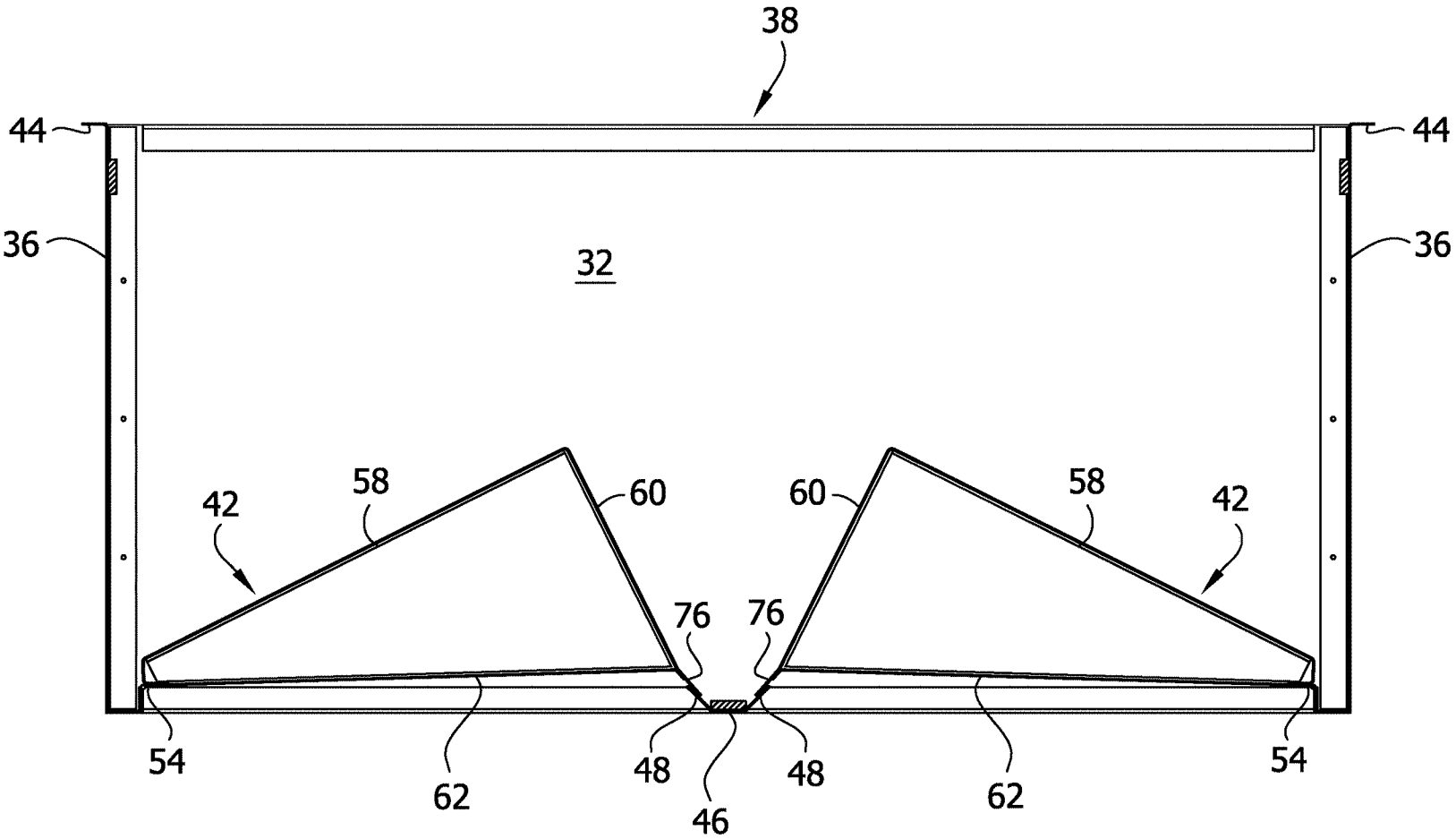
FIG. 6 is a cross section of FIG. 5 taken along line 6-6.
Figure 7:
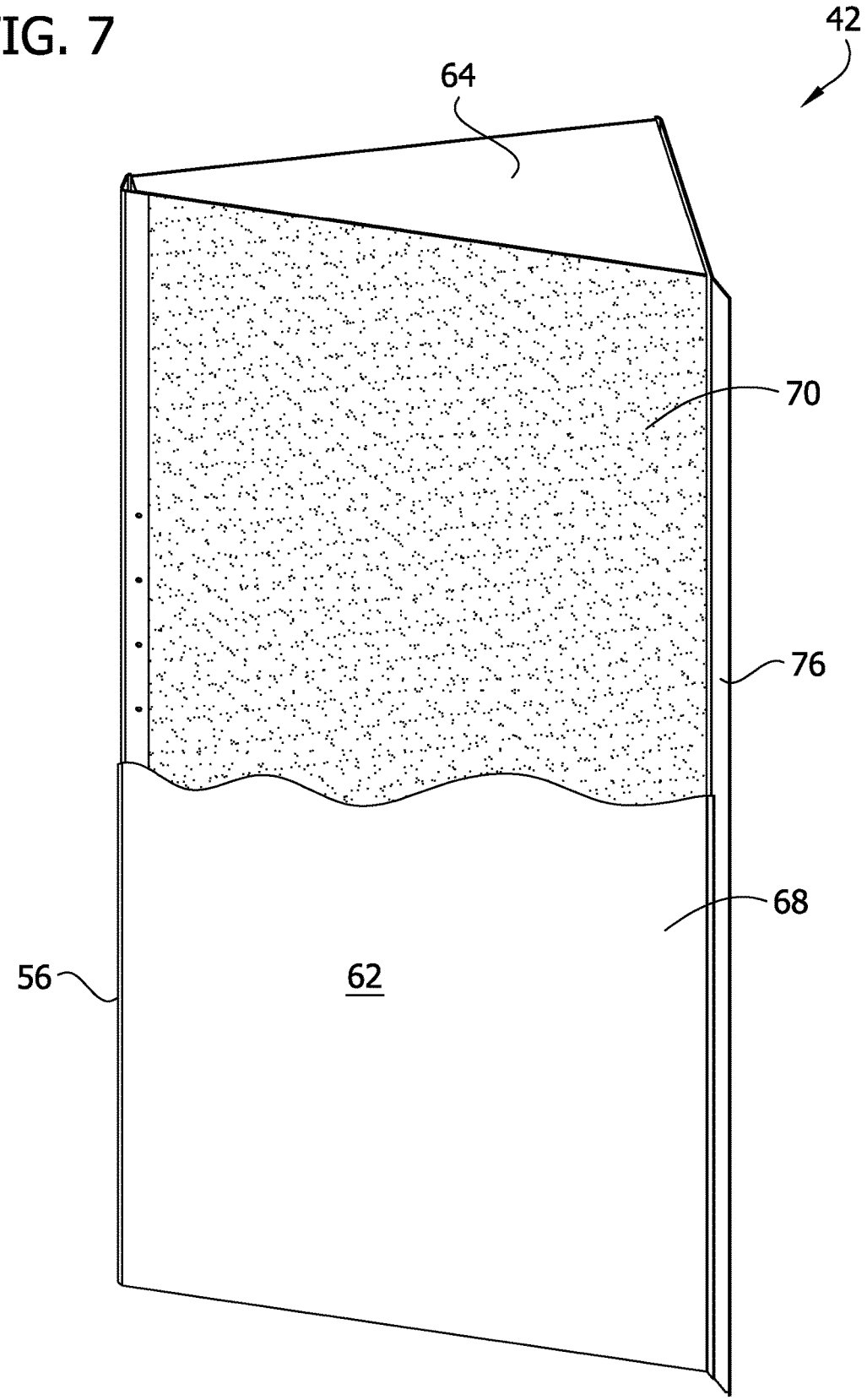
FIG. 7 is a perspective of a door of the backflow preventer with a part broken assay to show internal construction.
Figure 10:
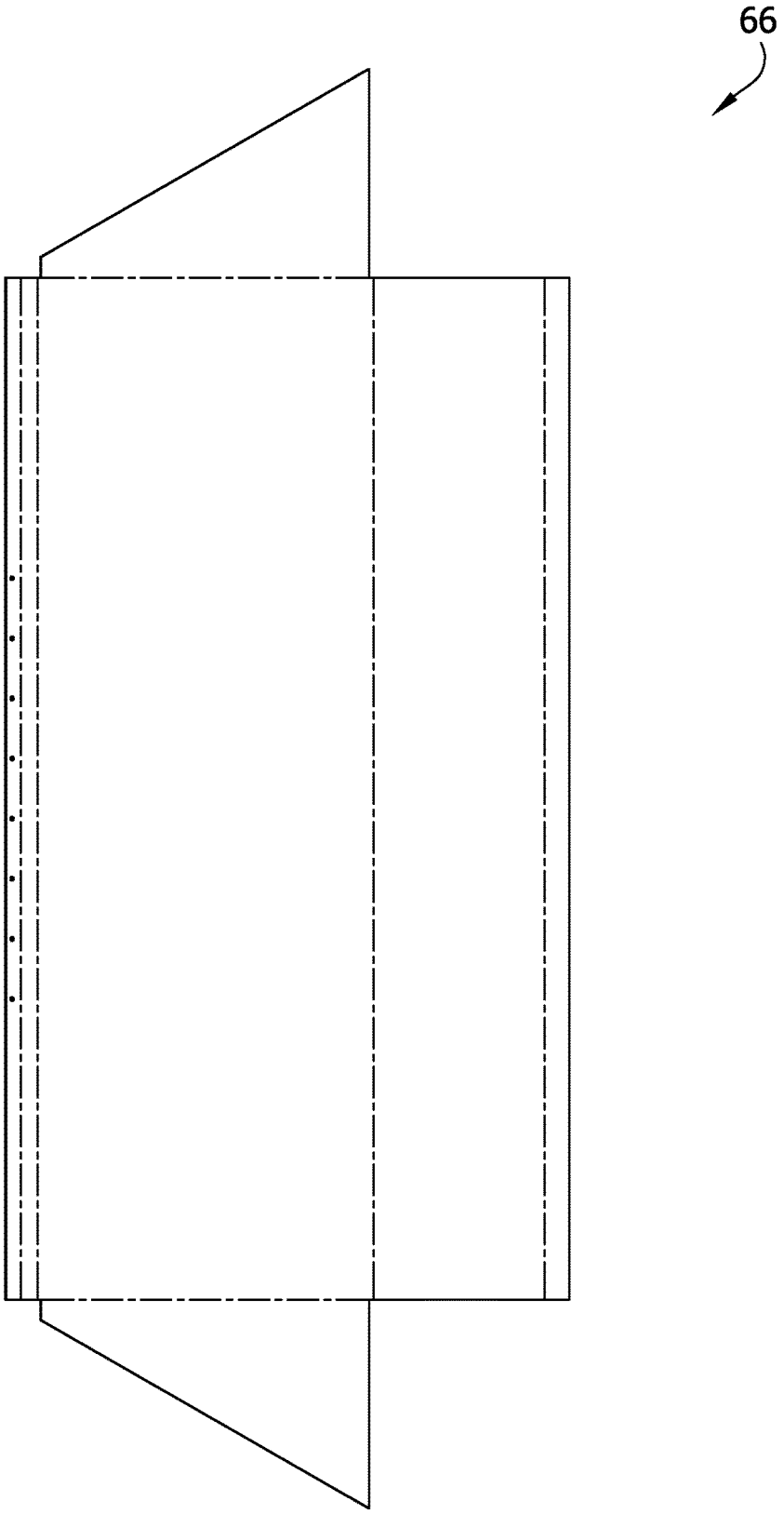
FIG. 10 illustrates a blank that can be used to form part of the doors of the backflow preventer.

The backflow preventer 14 further includes two doors 42 configured for movement between an open position (as illustrated in FIGS. 3 and 4) and a closed position (as illustrated in FIGS. 5 and 6). The doors 42 are mounted generally vertically inside the main body 30 and extend from the bottom wall 32 to the top wall 34. Each door 42 is hingedly attached to the main body 30, such as by a piano hinge 54 extending along the height of the door and attaching the door to one of the side walls 36. The doors 42 are free to pivot on the hinges 54. Preferably, the hinges 54 and the doors 42 are constructed and balanced so that the doors are not substantially gravitationally biased in either direction (i.e., toward the open position or toward the closed position). The doors 42 preferably swing freely about a vertical pivot axis. Other structures for movably attaching the doors 42 to the main body 30 are within the scope of the present invention. Each door 42 includes a hollow body 56. In the illustrated embodiment, the hollow body 56 is generally triangular, although other shapes and configurations are within the scope of the present invention. The generally triangular body 56 includes a first side 58, a second side 60, a third side 62, a top 64, and a bottom (not shown). The first side 58, the second side 60, the top 64, and the bottom can be formed from one piece by folding a blank, such as blank 66 illustrated in FIG. 10. In one embodiment, the first side 58, second side 60, top 64, and bottom are all formed from one piece of galvanized steel, such as an 18-gauge galvanized steel sheet, though other materials are within the scope of the present invention. A separate cover 68 forms the third side 62 of the generally triangular body 56. The cover 68 can be formed from any suitable material, such as galvanized steel. In one embodiment, the cover 68 is formed from a perforated 20-gauge galvanized steel sheet. The hollow body 56 is filled with an insulating material 70 (see FIG. 7) to reduce the noise of operation of the fan 18. Any suitable insulating material can be used, such as the acoustical board sold by Knauf Insulation of Shelbyville, Ind. It is understood that other materials and configurations of the doors 42 can be used without departing from the scope of the present invention, such as the generally triangular body being formed as one piece or as several separate pieces, and the doors being made of other suitable materials such as mill finished aluminum or stainless steel.

The first side 58 of each door 42 is positioned adjacent and generally parallel to one of the side walls 36 when the door is in the open position. The third side 62 extends at an angle $\alpha$ from the first side 58 and extends across the open front end 40 when the door 42 is in the closed position (FIG. 4). The angle $\alpha$ between the first side 58 and the third side 62 is preferably less than 90 degrees. In one embodiment, the angle $\alpha$ is about 20-30 degrees, and in another embodiment is about 24-26 degrees. When the doors 42 are in the open position, they form a tapered intake passageway extending from a wide opening adjacent the front open end 40 to a smaller opening adjacent the rear open end 38 of the backflow preventer 14 for funneling air into the fan 18. The smaller opening of the tapered intake passageway adjacent the rear open end 38 is preferably wider than the fan inlet 20. An angle $\beta$ of the tapered intake passageway formed by the doors 42 is preferably less than 90 degrees. Depending on the size of the backflow preventer 14, the angle $\beta$ can be between 40 and 60 degrees, and in one embodiment is about 48-52 degrees. As seen in FIGS. 4 and 6, each of the doors 42 includes an extension 76 extending into the main body 30 beyond the junction of the second side 60 and the third side 62. An angle $\gamma$ between the extension 76 and the second side 60 is preferably less than 30 degrees. In one embodiment, the angle $\gamma$ is approximately 15 degrees. The extension 76 is configured to contact the central stop 45 when the door 42 is in the closed position in order to completely close the open front end 40 of the main body 30. Each extension 76 contacts a side portion 48 of the central stop 45 to close the open front end 40.

In use, the multiple fan array system is operably attached to a building for conditioning the air in the building. The fan units 12 draw air from an external inlet area surrounding the open front end 40 of the backflow preventers 14 and discharge the air into a discharge area downstream from the fan outlet 22. The discharge area is typically an enclosed space, such as the building ventilation system. When each of the fan units 12 in the fan array system 10 is operating to draw air in through the inlet 20 and expel air through the outlet 22, the doors 42 of each backflow preventer 14 remain in the open position shown in FIGS. 3 and 4. Because of the configuration of the doors 42, and specifically the tapered intake passageway formed by the doors, air is directed or funneled toward the fan inlet 20. In conventional fan array systems, the attachment of a backflow preventer reduces the efficiency of the fan. However, because of the funneling of air toward the fan inlet 20, the backflow preventer 14 unexpectedly increases the static efficiency of the fan 18. Testing has shown that the efficiency of the fans 18 is improved by a minimum of 3% by the backflow preventer 14. Furthermore, because of the insulation 70 filling the hollow body 56 of each door 42, the noise of operation of the fan 18 is reduced. Based on testing, the backflow preventer 14 reduces the sound at the inlet side of the fan 18 by approximately 10 dBA.

If one of the fan units 12 stops operating to draw air in through the inlet 20 and expel air through the outlet 22, the backflow preventer 14 associated with that disabled fan unit will prevent air from entering the disabled unit, thereby preventing backflow in the fan array system 10. When one of the fan units 12 stops working, the back pressure in the discharge area created by the other fan units that are still operable forces the doors 42 of the backflow preventer 14 mounted on the disabled unit to move to the closed position (i.e., toward the lower pressure inlet area). As discussed above, when the doors 42 are in the closed position, the third side 62 of each door extends across the open front end 40 of the backflow preventer 14, and the extensions 76 of each door contact the side portions 48 of the central stop 45 to completely close the front end of the main body 30. Thus, when the doors 42 are in the closed position, air is prevented from flowing into or out of the disabled fan unit 12. Because the backflow preventer 14 uses pressure to close the doors 42, no additional closing structure or mechanism is required. The doors 42 are not biased toward the open position or the closed position by gravity or by any structure, such as a spring, and can swing freely on the hinges 54. Furthermore, because the backflow preventer 14 does not rely on gravity to close or open the doors 42, the fan unit 12 does not need to overcome the weight of the doors to open or close them; only the mass of the doors must be overcome. Therefore, the air flow into the fan is not disrupted as much as in conventional backflow preventers. A downstream static pressure as small as 0.5 inchWC is enough to force the doors 42 of the backflow preventer 14 closed. When the backflow preventer 14 prevents air from flowing through a disabled fan unit 12, the other fan units in the fan array system 10 continue to operate normally so that operation of the air handling system is not affected. If the disabled fan unit 12 becomes operable again, the pressure differential caused by the fan 18 drawing air into the inlet 20 will cause the doors 42 to open again.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above products and methods without departing from the scope of the invention, it is intended that all matter contained in the above description and shown in the accompanying drawings shall be interpreted as illustrative and not in a limiting sense.

What is claimed is:

1. A backflow preventer for use in an air handling system including at least one fan having an inlet and an outlet for drawing air from an inlet area and expelling air into a discharge area, the backflow preventer comprising:

a main body having a top wall, a bottom wall, and opposed side walls extending between the top and bottom walls, the main body defining an open front end and an open rear end and adapted for attachment to the fan of the air handling system adjacent the inlet of the fan such that air flowing into the fan inlet must first pass through the main body; and doors attached to the main body and configured for movement between an open position in which air is permitted to enter through the open front end to flow toward the open rear end and a closed position in which the doors block the open front end and air is prevented from entering through the open front end to flow toward the open rear end, the doors being movable between the open position and the closed position by a pressure differential between the inlet area and the discharge area, the attachment of the doors to the main body being configured so that when the main body is mounted on the at least one fan, the doors are not biased toward the closed position when the fan is off.

2. The backflow preventer of claim 1, wherein each of the doors comprises a hollow body filled with acoustic insulation.

3. The backflow preventer of claim 1, wherein the doors in the open position form a tapered intake passageway having a wider opening adjacent the open front end and a smaller opening adjacent the open rear end.

4. The backflow preventer of claim 3, wherein a horizontal cross section of each of the doors is generally triangular in shape.

5. The backflow preventer of claim 3, wherein the angle of the tapered intake passageway is in the range of 48 to 52 degrees.

6. The backflow preventer of claim 1, wherein each of the doors is hingedly attached to one of the opposed side walls for pivoting about a vertical axis.

7. The backflow preventer of claim 1, wherein the main body further comprises a central stop extending between the bottom wall and the top wall at a location between the opposed side walls and adjacent the open front end.

8. The backflow preventer of claim 7, wherein each of the doors comprises an extension configured to contact the central stop when each of the doors is in the closed position.

9. The backflow preventer of claim 1, wherein the main body is made of galvanized steel.

10. A multiple fan array system for use in conditioning air in a structure by drawing air from an inlet area and expelling it into a discharge area, the multiple fan array system comprising:

at least two fans, each fan having an inlet and an outlet and being operable to draw air in through the inlet and expel air out through the outlet; and a backflow preventer operatively associated with each of the at least two fans, each backflow preventer comprising:

a main body defining an open front end and an open rear end; and a pair of doors attached to the main body and configured for movement between an open position in which air is permitted to enter through the open front end to be drawn into the fan inlet and a closed position in which air is prevented from entering through the open front end to be drawn into the fan inlet, the attachment of the doors to the main body being configured so that when the main body is mounted on a respective fan, the doors are not biased toward the closed position when the respective fan is off.

11. The multiple fan array system of claim 10, wherein the doors of each backflow preventer are in the open position when all of the at least two fans are operable, and upon one of the at least two fans becoming inoperable the doors of the corresponding backflow preventer are configured to move to the closed position to prevent air from entering through the open front end of the corresponding backflow preventer to be drawn into the inoperable fan.

12. The multiple fan array system of claim 10, wherein each of the backflow preventers includes a flange configured to mount the backflow preventer on a corresponding fan such that the open rear end is adjacent the fan inlet.

13. The multiple fan array system of claim 10, wherein each of the doors comprises a hollow body filled with acoustic insulation.

14. The multiple fan array system of claim 10, wherein the doors of each backflow preventer in the open position form a tapered intake passageway having a wider opening adjacent the open front end and a smaller opening adjacent the open rear end.

15. The multiple fan array system of claim 14, wherein the angle of the tapered intake passageway is in the range of 48 to 52 degrees.

16. The multiple fan array system of claim 15, wherein the tapered intake passageway directs air into the fan inlet, thereby increasing efficiency of the fan by about 3%.

17. The multiple fan array system of claim 14, wherein a horizontal cross section of each of the doors is generally triangular in shape, a side of each of the doors forming a portion of the tapered intake passageway when the doors are in the open position and extending across the open front end when the doors are in the closed position.

18. The multiple fan array system of claim 10, wherein the main body of each of the backflow preventers further comprises a central stop.

19. The multiple fan array system of claim 18, wherein each of the doors comprises an extension configured to contact the central stop when each of the doors is in the closed position.

20. The multiple fan array system of claim 10, wherein each of the doors is hingedly attached to the main body of the backflow preventer for pivoting about a vertical axis.

21. A backflow preventer for use in an air handling system including at least one fan having an inlet and an outlet for drawing air from an inlet area and expelling air into a discharge area, the backflow preventer comprising:

a main body having a top wall, a bottom wall, and opposed side walls extending between the top and bottom walls, the main body defining an open front end and an open rear end and adapted for attachment to the fan of the air handling system adjacent the inlet of the fan such that air flowing into the fan inlet must first pass through the main body; and doors attached to the main body and configured for movement between an open position in which air is permitted to enter through the open front end to flow toward the open rear end and a closed position in which the doors block the open front end and air is prevented from entering through the open front end to flow toward the open rear end, the doors being movable between the open position and the closed position by a pressure differential between the inlet area and the discharge area, the attachment of the doors to the main body being configured so that when the main body is mounted on the at least one fan, the doors are not biased toward the open position or the closed position.

* * * * *